United States Patent [19]

Gruber

[11] Patent Number: 4,474,585

[45] Date of Patent: Oct. 2, 1984

[54] SYNTHETIC YARN-REINFORCED FLEXIBLE WEBS STABILIZED AGAINST ELONGATION, COATED ABRASIVE THEREON, AND PROCESS THEREFOR

[75] Inventor: David P. Gruber, Scotia, N.Y.

[73] Assignee: Norton Company, Mass.

[21] Appl. No.: 499,688

[22] Filed: May 31, 1983

[51] Int. Cl.[3] ..... C09K 3/14

[52] U.S. Cl. ..... 51/298; 427/171; 427/175; 427/381; 427/386; 427/329.9; 427/412; 428/240; 428/257; 428/323; 428/102; 428/105; 428/109

[58] Field of Search ..... 51/298; 428/257, 240, 428/323, 102, 105, 109; 427/171, 175, 386, 381, 389.9, 412

[56] References Cited

U.S. PATENT DOCUMENTS

| | | | |
|---|---|---|---|
| 4,035,961 | 7/1977 | Pemrick et al. | 51/295 |
| 4,140,829 | 2/1979 | Pemrick et al. | 428/246 |
| 4,396,657 | 8/1983 | Ibrahim | 428/283 |
| 4,437,865 | 3/1984 | Parekh et al. | 428/102 |

FOREIGN PATENT DOCUMENTS

| | | |
|---|---|---|
| 45408 | 2/1982 | European Pat. Off. . |
| 73313 | 3/1983 | European Pat. Off. . |

*Primary Examiner*—James J. Bell

*Attorney, Agent, or Firm*—Frank S. Chow

[57] ABSTRACT

Conventional heat stretching and/or setting conditions for fabrics made of heat sensitive thermoplastic yarns such as polyester, and even special techniques advanced in prior patents, have been found in adequate to produce coated abrasives with sufficient elongation resistance for some very heavy duty service. A superior alternative is provided by encasing the yarns in the backing in a thermosetting adhesive and then curing it while mechanically restraining the yarns from shrinking, as they would under the temperature conditions employed for cure if no restraint were used. The method is also applicable to other types of yarn reinforced web materials for which a combination of elongation resistance and flexibility is needed.

17 Claims, No Drawings

SYNTHETIC YARN-REINFORCED FLEXIBLE WEBS STABILIZED AGAINST ELONGATION, COATED ABRASIVE THEREON, AND PROCESS THEREFOR

BACKGROUND OF THE INVENTION

1. Field of the Invention

This invention relates to webs or backings which are reinforced with organic synthetic thermoplastic yarns, are ultimately utilized in products requiring a combination of good elongation resistance with sufficient flexibility to accommodate to repeated curving and flexing, and are exposed to heat either in ultimate use or during manufacture of the product in which they are ultimately used. Examples of such products include conveyor and power transmission belts, hoses, skirts for air supported vehicles such as marine hovercraft, shells for air supported structures, and backings for coated abrasives to be used in belt form. This invention is particularly related to the latter group of products. The synthetic yarns may be present in the webs as individual yarns or in the form of fabrics. The invention is more particularly related to coated abrasives reinforced in one of the manners described in U.S. application Ser. No. 06/420,466 by Yarbrough, filed Sept. 20, 1982, the specification of which is incorporated herein by reference.

2. Description of the Prior Art

Excessive stretch or elongation of backings which depend on synthetic thermoplastic textile yarns for their primary strength members has been a serious concern ever since these synthetic yarns began to be used to replace cotton as reinforcing yarns. Various expedients, primarily heat-stretching, have been used to ameliorate the problem and are well known in the various arts in which the problem has been encountered. With respect to coated abrasives, some of the first practical means of reducing stretch were described in U.S. Pat. Nos. 4,035,961 and 4,140,829 to Pemrick and Cocanour. While the methods described in these patents were substantial improvements over the prior art at the time and provided products which are satisfactory for many applications of coated abrasives, as evidenced by continuing commercial sales, there are some applications for which the stretch resistance achieved by these methods is not fully satisfactory.

A more recent development, which is especially useful in combination with the methods of Pemrick and Cocanour and for backings in which continuous filament synthetic yarns provide the primary elongation resistance, is described in U.S application Ser. No. 06/334, 710 by Ibrahim, now U.S. Pat. No. 4,396,657 and is incorporated herein by reference. This Ibrahim method also advanced the prior art but has proved not to be entirely satisfactory in all cases. For applications requiring truly extraordinary stretch resistance, especially when substantial heat is generated, still further improvement is indicated.

Most workers in the prior art have relied on measurements at room temperature to characterize the adequacy of elongation resistance, and the most common measurement has been a conventional single tensile test per web, backing, or product sample on a laboratory tensile and elongation test machine. In part at least, this method of testing has reflected a strong tendency in the prior art to regard conventional heat setting and/or stretching as "permanently" stabilizing yarns against shrinkage at any temperature significantly lower than that of prior heat setting and/or stretching.

SUMMARY OF THE INVENTION

It has now been discovered that a significant source of undesirable elongation in backings comprising synthetic thermoplastic yarns as their primary strength members is the shrinkage of such yarns during exposure to heat, even after the yarns have been heat stretched and/or set at higher temperatures. E.g., polyester yarns set at more than 200° C. still shrink significantly when exposed to 121° C., and such shrinkage drastically increases susceptibility to elongation in later use. The shrinkage and the elongation can both be reduced to levels lower than heretofore achieved by restraining the yarns with sufficient force during all stages of manufacture when the yarns are exposed to heat. In backings or products which have continuous yarns extending throughout the entire object or a substantial portion thereof, the restraint can be provided by direct mechanical means. It has now been found possible, however, and is normally more convenient, to achieve the restraint by impregnating and/or encasing the yarns at an early stage of manufacture with an adhesive which is capable of curing to give a solid of high modulus and by curing the adhesive sufficiently to obtain such a modulus while preventing shrinkage via mechanical restraint. If the attachment of the warp yarns to this encasing and/or impregnating adhesive is sufficient, the yarns will not be able to shrink in subsequent processing steps because of the restraint imposed by the adhesive. It is thereby possible to achieve very low elongation while using the final product even under conditions which generate considerable heat, without the need for gross mechanical restraint against yarn shrinkages at the later stages of manufacture, where such restraint may be particularly inconvenient or expensive to supply.

In quantitative terms, I have found that yarns and fabrics with over 1% free shrinkage at 121° C. can be stabilized in this manner so that the free shrinkage is reduced to 0.5% or less at the same temperature, and that coated abrasives can be made so that they will have a maximum elongation of 3.1% or less when repeatedly cycled between tensile loads of 3.6 and 18.3 kilonewtons per meter (kN/m) of width at a temperature of 66° C. Coated abrasives which meet this criterion have been found to give superior performance in elongation-prone applications, even though their elongation behavior when tested at room temperature was indistinguishable from that of less effective conventional coated abrasives.

If a fabric or other collection of yarns has less than 1% natural free shrinkage at the highest temperature to which it is to be exposed, no stabilization in the manner of this invention is normally needed. E.g., for coated abrasives with conventional phenolic resin maker and size adhesives, a temperature of 121° C. is normally the maximum used in cure, and if a fabric shrinks less than 1% at this temperature, there is little need to stabilize it. Furthermore, if the yarns reinforcing a web or product supply less than half the tensile strength of the web or product in any direction, the instant invention is also not normally valuable for that product.

DESCRIPTION OF THE PREFERRED EMBODIMENTS

This invention is particularly suitable for use with yarn reinforced coated abrasive backings as described in Ser. No. 06/420, 466. In such backings normally all the warp yarns are on one side of the backing, and thus can conveniently be encased and/or impregnated with an adhesive without substantially impregnating the other yarns in the backing at the same time. The side with the warp direction yarns can conveniently be made the back of the eventual coated abrasive product, so that the cure of the adhesive needed to stabilize the warp yarns against shrinkage does not necessarily entail extensively exposing such a cured adhesive on the side of the product to be coated with abrasive grits. It is well known in the art that inferior grits adhesion can be the result of excessively advancing the cure of any adhesive used on the front side of the backing before the maker adhesive, which is to hold the grits, is applied. When the warp yarns, which are the principal determinants of elongation resistance, are segregated on the back side of the backing web, a substantially advanced resin adhesive encasing and/or impregnating them can be combined with a very slightly advanced resin on the front side of the backing to maintain receptivity to forming a strong bond with the maker adhesive coat to be applied later. Such a combination of the instant invention with that disclosed in application Ser. No. 06/420,466 is highly preferred.

It is preferred that the yarns which are to lie in the stretch resisting direction in a final coated abrasive product should form a substantially coplanar and coparallel array as described in the Yarbrough Application cited above. Most preferable is the embodiment in which all such yarns form a single array which is disposed on one side of all the other reinforcing yarn arrays in the backing, and in which the stretch resisting yarns are disposed on the opposite side from the abrasive grits coating in the final product. Several fabrics highly suitable for use in this way are described in U.S. application Ser. No. 06/297,538 by Darjee, which application is incorporated herein by reference.

While thermoplastic textile yarns of almost any type may be used with the instant invention, yarns of the common and economical synthetic yarns such as polyester, polyamide, and polyacrylonitrile are preferred. Particularly preferred, primarily because of their relatively low cost per unit tensile strength, are continuous multifilament high tenacity polyester yarns in deniers from 840 to 2600.

The most straightforward way of achieving the desirable products of this invention is to carry out every step of the manufacture of a backing and a coated abrasive coated thereon while maintaining a tensile force on the backing sufficient to prevent any lengthwise shrinkage during any process in which heat is applied to the backing. However, this procedure is not normally preferred in practice, because existing commercial equipment for drying and/or cure of adhesives in the making and grits sizing stages is not provided with the necessary mechanical means to achieve such restraint. Accordingly, it is normally preferred, for reasons of economy, to achieve the stabilization of warp yarns against elongation by encasing and/or impregnating these yarns at a fairly early stage of cloth finishing with an adhesive which can be cured to a solid with sufficiently high modulus and sufficently good adhesion to the yarns to restrain them from elongation in subsequent use. Part of this restraint against ultimate elongation, as already noted, is achieved by restraining the yarns against free shrinkage that could otherwise occur in later stages of manufacturing. Such an adhesive is described herein as a stabilizing adhesive.

Suitable stabilizing adhesives are normally thermosetting resins, in order to achieve a high modulus which is not severely reduced by exposure to heat. The adhesives must also form strong bonds with the yarns to be stabilized, or with some other adhesive which is applied to these yarns first for other purposes, e. g., supplemental stabilization and fray resistance as described in the Ibrahim application cited above. Polyimides, suitably formulated urethanes, radiation curable acrylates, etc. are all suitable. For most coated abrasive uses, resorcinol- and/or phenol-formaldehyde resins are preferred, for economy and compatibility with the usual phenol-formaldehyde maker and sizing resins for such products. As a matter of processing convenience and economy, rapidly curable adhesives are preferred, and for this reason resins which contain some organic solvent are often preferred over those which are purely water based, because the latter are more likely to blister when rapidly dried.

In order to measure and define the adequacy of the stabilization achieved, it is convenient to have a laboratory test method, although the ultimate criterion of success must be adequate performance in actual applications of coated abrasives to practical use. It has been found that a good correlation is obtained between belt performance in elongation-prone use and laboratory measurement of elongation under cyclic loading between two tensile forces at a temperature of 66° C.

For this test, an Instron tester was used, with a sample of backing or coated abrasive product 2.5 cm in width and an initial jaw opening of 25.4 cm at zero tensile force. The sample was equilibrated at the test temperature and then subjected to extension at a rate of 2.5 cm/min until a force of the chosen upper limit was registered. At this point, the jaws reversed direction and closed at the same rate until the tensile force was reduced to the chosen lower limit. This cycling was automatically continued, with continuous recording of the jaw spacing and tensile force, until several cycles had given the same jaw spacings for each value of tensile force. The tensile force was then returned to zero. The maximum elongation reached in the first cycle was denoted as A and the maximum elongation in the final cycle(s) was denoted B. The difference between the initial and final lengths for zero tension was recorded, as a percent of the initial length, as the permanent deformation, denoted C. It was found that C was always positive and that B was always larger than A. The most important correlation with practical performance was found to be with elongation B: if that value in a final coated abrasive product was 3.1% or less in cycling between 3.6 and 18.3 kN/m at 66° C., satisfactory stretch resistance even in demanding applications was found.

It should be noted that the description above has been given in terms of stabilization of warp yarns, simply because these yarns in the fabric as manufactured most often become the principal elongation resisting yarns in the coated abrasive belts as used. It is, however, also well known in the art to make sectional belts for applications demanding greater belt width than is available in coated abrasive webs from many commercial makers. In such cases, the elongation resistance of the final belts is more dependent on the yarns in the fill rather than the warp direction of the original fabric backing used. For coated abrasives to be used in this fashion, the fill rather than the warp yarns should be stabilized. In general, the Yarbrough application and certain other prior art teach the possibility of more than two arrays of yarns oriented in various directions in the backing, and all the yarns which will lie in or near to the direction in which maximum stretch resistance of the final belt is desired should preferably be stabilized as described herein.

Furthermore, although the preferred embodiments have been described principally in terms of backings suitable for coated abrasives, it is clear that very similar applications can be made to other fields. Webs for air-supported structures, e.g., normally need stretch resistance approximately equal in all directions in the plane of the backing. For such a use, a web should have all its yarns stabilized by the methods described herein. (For such an application, normally no additional coating on one surface only is needed as for coated abrasives, so that the possibility of reduced adhesion of such a coating is of no practical consequence.) A web for conveyor belts, on the other hand, is more like one for coated abrasives in that elongation resistance in one direction is normally much more important than in other directions.

The benefits and application of the instant invention are further illustrated by the following examples.

EXAMPLE 1

A stitch bonded fabric consisting of 14 warp yarns of 1300 denier high tenacity multifilament polyester per 25 mm of fabric width, 96 fill yarns of 170 denier texturized multifilament polyester per 25 mm of fabric length, and stitch yarns of 140 denier high tenacity polyester was used as the substrate for this example. Further details of the construction and method of manufacture of this type of fabric are given in the Darjee application cited above.

This fabric was first saturated with an epoxy resin emulsion and an imidazole curing agent to extent of 67 dry gm/m$^2$. Details of preferable resin compositions and methods of saturation are given in the Ibrahim application cited above. The fabric was then ready for the stabilization process according to this invention.

The stabilizing adhesive used was a mixture of Resinox 7451, a phenolic laminating resin in methanol supplied by Monsanto Co., St. Louis, MO 63166, 30 parts by weight; finely ground calcium carbonate, 40 parts by weight; and paraformaldehyde, 3 parts by weight. This mixture was applied to the warp yarn side of the saturated fabric by knife coating so as to give a layer with a dry add-on weight of 118–148 gm/m$^2$ thoroughly encasing the warp yarns. The applied adhesive was then subjected to cure under various time and temperature programs as shown in Table 1 below. During the cure, the samples were kept under a tensile force of more than 3 kN/m to prevent free shrinkage.

Because of cooling of the oven when it is opened to admit the samples, evaporation of solvents, and other factors, it is generally suspected that the actual temperature attained by the backing when curing samples for such short times as these is not as high as the nominal oven temperature. Therefore, a set of temperature recording appliques (available from Telatemp Corp., Fullerton, Calif.), was affixed to each sample. These are capable of measuring the maximum temperature attained at their surface within three degrees Celsius. The temperature of the highest changed applique is shown as the "Actual Backing Temperature" in the Table.

For each time and temperature program shown in the Table, there are two entries for each of the three elongation numbers already defined. The first set of these entries is for backing samples which were subjected to the cycling testing without further exposure to heat above room temperature between the cure and the cyclic testing. The second set of entries is for samples which were allowed to shrink freely under ten minutes exposure to 121° C. between cure and testing.

The results in the Table clearly show the deleterious effect of free shrinkage on elongation resistance, along with the reduction of this deleterious effect effected by greater degrees of cure of the stablizing adhesive. Either five minutes at a backing temperature of 177° C. or two to four minutes at 188° C. yields backings with no more than 0.5% free shrinkage in the test shown.

TABLE 1

Effect of Extent of Cure of Stabilizing Adhesive on Backing Shrinkage Susceptibility and Elongation Resistance

| Cure Conditions | | | | Percent Elongation and Deformation:[1] | | |
|---|---|---|---|---|---|---|
| Oven Temperature, °C. | Exposure Time, Min | Actual Backing Temperature, °C. | Percent Free Shrinkage[2] | A | B | C |
| No Stabilizing Adhesive Used | | | — | 3.7 | 3.9 | 1.3 |
| " | | | 1.2 | 5.6 | 5.7 | 3.0 |
| 191 | 2 | 163 | — | 2.3 | 2.5 | 0.5 |
| " | " | " | 2.4 | 5.1 | 5.3 | 3.0 |
| 204 | 2 | 177 | — | 2.1 | 2.3 | 0.6 |
| " | " | " | 2.1 | 4.5 | 4.8 | 2.7 |
| 204 | 5 | 177 | — | 1.7 | 1.8 | 0.4 |
| " | " | " | 0.5 | 2.2 | 2.5 | 0.7 |
| 224 | 2 | 188 | — | 2.1 | 2.3 | 0.6 |
| " | " | " | 0.4 | 2.9 | 3.2 | 1.6 |
| 224 | 3 | 188 | — | 1.9 | 2.1 | 0.7 |
| " | " | " | 0.5 | 2.4 | 2.7 | 0.9 |
| 224 | 4 | 188 | — | 1.7 | 1.9 | 0.4 |
| " | " | " | 0.2 | 2.3 | 2.5 | 0.7 |

[1]During cycling between tensions of 3.6 and 18.3 kN/m at 66° C.; the designations A, B, and C are explained above.
[2]Upon exposure to 121° C. for 10 minutes without mechanical restraint.

Some of the most elongation backings shown in Table 1 were then further processed to make coated abrasives by the processes shown in detail in the Ibrahim application already cited. These processes entail heating at 100° C. or more for many hours in order to achieve full cure of the phenol-formaldehyde maker and sizer resin adhesives used. When such cure was performed without any restraint against shrinkage, the resulting coated abrasives had at best 3.8% B value elongation. While a considerable improvement over results achieved for otherwise similar products without any stablizing adhesive, this level of elongation resistance is still not entirely satisfactory for all coated abrasives.

If one of these stablized backings, or indeed almost any other coated abrasive backing with a considerable amount of thermosetting resin encasing and/or impregnating the yarns, was converted to a coated abrasive while under sufficient tensile force to prevent free shrinkage at any stage of processing, fully satisfactory elongation resistance wss achieved. However, it was usually not achieved until the final cure after making, sizing, and preliminary sizer cure, and as already stated above, maintaining a coated abrasive under tension during the late stages of cure is generally impractical in large-scale manufacturing.

(End of Example 1)

The results shown in Example 1 indicated the general direction of changes to be made to achieve satisfactory stabilization at an early stage of commercial scale manufacture. Such a result is shown in Example 2.

EXAMPLE 2

For this example, a stitch bonded fabric consisting of 14 warp yarns of 1300 denier high tenacity polyester per 25 mm of fabric width, 128 fill yarns of 150 denier texturized polyester per 25 mm of fabric length, and 70 denier high tenacitY polyester stitch yarns was used. Again, details of the construction of this fabric are given in the above cited Darjee Application.

This fabric was saturated in the same manner as for Example 1, with the important exception that the fabric was stretched 2.5-3% of its original length in the tenter frame before drying. The stabilizing adhesive was the same as in Example 1, except that hexamethylene tetraamine was substituted for the paraformaldehyde. (Any formaldehyde donor is considered equivalent for use in this formula.) In contrast to Example 1, the stabilizing adhesive for this example was dried in a continuous oven, so that the backing reached actual oven temperatures, which were 121° C. for two minutes followed by 204° C. for one minute. As in Example 1, the cure of the stabilizing adhesive was accomplished while the web was under restraint in the warp direction, so that no shrinkage of the warp yarns could occur. The amount of stabilizing adhesive was the same as in Example 1. After completion of the stabilizing process, the backings were given a frontfill, another backfill, and then made into coated abrasives with phenolic resin maker and size adhesives in the manner described in detail in the Ibrahim Application cited above.

The elongation results for products made in this way are shown in Table 2 and compared with those achieved by proceeding according to the original Ibrahim directions. It is clear from the Table that the stabilizing adhesive has considerably improved the elongation resistance as measured by cyclic testing of heated samples.

The superior quality of coated abrasives prepared according to this Example was confirmed by field testing in grinding of 40–50 pound grade industrial particleboard about 125 cm in width, using a Kimwood Serial 50145 machine with 125 horsepower driving motor and a steel contact roll about 250 cm in diameter. The particle board was passed through the grinding nip at a rate between 25 and 35 meters per minute. Performance with the belts of coated abrasives according to this Example averaged at least 25% greater than when conventional products were used.

(End of Example 2)

EXAMPLE 3

The saturation adhesive and process for this example were identical to that for Example 2. However, the backfill adhesive described in the Ibrahim Application was used in this Example as the stabilizing adhesive. It was applied as in the cited Application, but was cured under tensile restraint for two hours at 113° C. rather than for only a few minutes as described by Ibrahim. Subsequent processing steps proceeded as described by Ibrahim. An elongation B value of 2.5% in cyclic testing between 3.6 and 18.3 kN/m at 66° C. was obtained.

TABLE 2

Effect of Stretch During Saturation and Stabilizing Adhesive on Elongation Resistance of Coated Abrasives Cyclically Tested with Various Upper Load Limits

| Product Type/Description | Upper Limit Test Load, kN/m | Percent Elongation and Deformation at 66° C. When Cycled from 3.6 kN/m A | B | C |
|---|---|---|---|---|
| Grit 120 Closed Coat SiC on backing prepared according to 06/334,710 | 12.8 | 1.4 | 2.0 | 0.5 |
| | 14.6 | 2.2 | 2.6 | 0.8 |
| | 16.4 | 2.9 | 3.4 | 1.3 |
| | 18.3 | 4.0 | 4.4 | 1.9 |
| Grit 100 Closed Coat SiC Cloth on Stabilized Backing, Otherwise as Above | 12.8 | 0.9 | 1.2 | 0.2 |
| | 14.6 | 1.2 | 1.5 | 0.3 |
| | 16.4 | 1.5 | 2.0 | 0.4 |
| | 18.3 | 2.3 | 3.1 | 1.6 |
| Grit 36 Open Coat NorZon[1] Cloth on Backing According to 06/334,710 | 18.3 | 4.5 | 5.1 | 2.7 |
| Grit 36 Open Coat NorZon[1] Cloth with Stablization Replacing Backfill of Item Above | 18.3 | 2.2 | 2.7 | 0.9 |
| Grit 36 Open Coat NorZon[1] Cloth with Stabilization plus all other finishing treatments of 06/334,710 | 18.3 | 1.5 | 2.0 | 0.6 |

[1]Trade mark of Norton Company for products coated with zirconiaalumina grits.

(End of Example 3)

EXAMPLE 4

This example is the same as Example 3, except for the stabilization stage. The stabilizing adhesive was a mixture of Uvithane 783 from Thiokol Chemical, 572 parts; pentaerythritoltriacrylate, 572 parts; Celrad 3700 from Celanese Chemical, 572 parts; N-vinyl pyrrolidone, 484 parts; Irgacure 651 from Ciba-Geigy, 100 parts; Tyzor TBT from DuPont Chemical, 60 parts; fumed silica, 50 parts; and silica in about 1000 mesh size, 3000 parts; all parts are by weight. (Uvithane and Celrad are acrylate oligomers, Irgacure is a photo-initiator, and Tyzor is an organotitanate adhesion promoter.) A mass, essentially the same both dry and wet, of 170–190 gm/m$^2$ of this adhesive was applied to the warp yarn side of the saturated fabric and then cured by two minutes exposure to ultraviolet light while the fabric was held in a pin frame, so that it could not shrink. Coated abrasive products with elongation B values of 2.7% in cyclic testing between 3.6 and 18.3 kN/m at 66° C. were obtained.

(End of Example 4)

In order to describe precisely the instant invention, it is useful to define certain additional special terms. A particular direction defined by a straight line lying in the plane of a web is denoted as a "reference direction". All the yarns in the web whose direction is within 45° of the reference direction are denoted together as the "reference direction yarn set". The amount of shrinkage which the yarns of any set would exhibit when exposed for at least ten minutes to a temperature of 121° C., in isolation from all other components of the backing and free from mechanical restraint, is denoted as the "natural shrinkage". If the yarns are present in the backing as part of a fabric, their shrinkage according to this criterion would be measured on the isolated fabric, not on separated yarns. Although the natural shrinkage can not usually be measured directly when the yarns of the reference direction yarn set are embedded in a composite structure, this value can be determined from knowledge of the fiber type, number, and size of the yarns in the set. If several different variations of the general fiber type or types found in the structure are commercially available and have significantly different shrinkage characteristics, the value for yarns of the highest tenacity variation is to be assumed.

What is claimed is:

1. A web material characterized by the presence of at least one reference direction for which the reference direction yarn set has at least one half the total tensile strength of said web material in said reference direction, said reference direction yarn set additionally having a natural shrinkage value of at least 1%, said web material having a free shrinkage of no more than 0.5% when exposed to a temperature of 121° C. for at least 10 minutes without mechanical restraint.

2. A web according to claim 1, wherein the said reference yarn set is predominantly a substantially coplanar and coparallel yarn array.

3. A web according to claim 2, wherein said substantially coplanar and coparallel yarn array is the warp or fill yarn array of a coherent stitch bonded fabric.

4. A web according to claim 3, wherein at least half the yarns of said substantially coplanar and coparallel yarn array are polyester with a tenacity of at least 8 gm/denier.

5. A web according to claim 4, wherein said reference yarn set is encased by a layer of material which is the product of the thermal cure of a phenol-formaldehyde or resorcinol-formaldehyde resin or of the radiation cure of multifunctional acrylates.

6. A web according to claim 3, wherein said reference yarn set is encased by a layer of material which is the product of the thermal cure of a phenol-formaldehyde or resorcinol-formaldehyde resin or of the radiation cure of multifunctional acrylates.

7. A web according to claim 2, wherein said reference yarn set is encased by a layer of material which is the product of the thermal cure of a phenol-formaldehyde or resorcinol-formaldehyde resin or of the radiation cure of multifunctional acrylates.

8. A web according to claim 1, wherein said reference yarn set is encased by a layer of material which is the product of the thermal cure of a phenol-formaldehyde or resorcinol-formaldehyde resin or of the radiation cure of multifunctional acrylates.

9. A coated abrasive comprising abrasive grits adhered to at least one major surface of a web material characterized by the presence of at least one reference direction for which the reference direction yarn set has at least one half the total tensile strength of said coated abrasive in said reference direction, said reference direction yarn set also having a natural shrinkage of at least 1%, said coated abrasive having a maximum elongation of not more than 3.1% when subjected to cyclic elongation testing between 3.6 and 18.3 kN/m at 66° C.

10. A coated abrasive according to claim 9, wherein the said reference direction yarn set is predominantly a substantially coplanar and coparallel yarn array.

11. A coated abrasive according to claim 10, wherein said substantially coplanar and coparallel yarn array is the warp or fill yarn array of a coherent stitch bonded fabric.

12. A coated abrasive according to claim 11, wherein at least half the yarns of said substantially coplanar and coparallel yarn array are polyester with a tenacity of at least 8 gm/denier.

13. A coated abrasive according to claim 12, wherein said reference direction yarn set is encased by a layer of material which is the product of the thermal cure of a phenol-formaldehyde or a resorcinol-formaldehyde resin or of the radiation cure of multifunctional acrylates.

14. A coated abrasive according to claim 11, wherein said reference direction yarn set is encased by a layer of material which is the product of the thermal cure of a phenol-formaldehyde or a resorcinol-formaldehyde resin or of the radiation cure of multifunctional acrylates.

15. A coated abrasive according to claim 10, wherein said reference direction yarn set is encased by a layer of material which is the product of the thermal cure of a phenol-formaldehyde or a resorcinol-formaldehyde resin or of the radiation cure of multifunctional acrylates.

16. A coated abrasive according to claim 9, wherein said reference direction yarn set is encased by a layer of material which is the product of the thermal cure of a phenol-formaldehyde or a resorcinol-formaldehyde resin or of the radiation cure of multifunctional acrylates.

17. A process for making a web material having at least one reference direction in which the free shrinkage is no more than 0.5% upon exposure to a temperature of 121° C. for at least 10 minutes from a reference direction yarn set which has a natural shrinkage of at least 1% and at least half the total tensile strength of said web material in said reference direction, comprising the steps of:

(a) encasing said reference direction yarn set, together with any adhesive impregnant or encasement previously applied to said reference yarn set, within a mass of a stablizing adhesive capable of cure to a solid state with a strain modulus and adhesion to the yarns of said set sufficient to restrain the yarns of said reference direction yarn set against more than 0.5% free shrinkage when exposed to a temperature of 121° C. for ten minutes; and (b) curing said stabilizing adhesive of part (a) while mechanically restraining the yarns of said reference direction yarn set from any shrinkage.

* * * * *